US008410429B2

(12) United States Patent
Franzen et al.

(10) Patent No.: US 8,410,429 B2
(45) Date of Patent: Apr. 2, 2013

(54) ION MANIPULATION CELL WITH TAILORED POTENTIAL PROFILES

(75) Inventors: Jochen Franzen, Bremen (DE); Gökhan Baykut, Bremen (DE); Oliver Räther, Lilienthal (DE); Carsten Stoermer, Bremen (DE); Evgenij Nikolaev, Moscow (RU)

(73) Assignee: Bruker Daltonik GmbH, Bremen (DE)

( * ) Notice: Subject to any disclaimer, the term of this patent is extended or adjusted under 35 U.S.C. 154(b) by 50 days.

(21) Appl. No.: 13/017,803

(22) Filed: Jan. 31, 2011

(65) Prior Publication Data

US 2011/0186728 A1 Aug. 4, 2011

(30) Foreign Application Priority Data

Feb. 1, 2010 (DE) ..... 10 2010 006 449
Mar. 31, 2010 (DE) ..... 10 2010 013 546

(51) Int. Cl.
*H01J 49/06* (2006.01)
*H01J 49/36* (2006.01)

(52) U.S. Cl. ..... 250/283; 250/293

(58) Field of Classification Search ..... 250/283, 250/290–297

See application file for complete search history.

(56) References Cited

U.S. PATENT DOCUMENTS

| | | | | |
|---|---|---|---|---|
| 5,572,035 | A | 11/1996 | Franzen | |
| 5,847,386 | A | 12/1998 | Thomson et al. | |
| 6,111,250 | A | 8/2000 | Thomson et al. | |
| 6,163,032 | A | 12/2000 | Rockwood | |
| 7,164,125 | B2 * | 1/2007 | Weiss et al. | 250/292 |
| 7,655,903 | B2 * | 2/2010 | Zubarev et al. | 250/291 |
| 2004/0222369 | A1 | 11/2004 | Makarov et al. | |
| 2007/0045533 | A1 * | 3/2007 | Krutchinsky et al. | 250/290 |
| 2007/0085000 | A1 * | 4/2007 | Furuhashi et al. | 250/288 |
| 2007/0181803 | A1 | 8/2007 | Hasegawa et al. | |
| 2008/0111070 | A1 | 5/2008 | Makarov et al. | |
| 2009/0206250 | A1 | 8/2009 | Wollnik | |
| 2009/0218484 | A1 | 9/2009 | Javahery et al. | |
| 2010/0038530 | A1 * | 2/2010 | Giles et al. | 250/283 |
| 2010/0181475 | A1 * | 7/2010 | Makarov et al. | 250/294 |
| 2010/0308218 | A1 * | 12/2010 | Wang | 250/292 |

* cited by examiner

*Primary Examiner* — Robert Kim
*Assistant Examiner* — David E Smith
(74) *Attorney, Agent, or Firm* — O'Shea Getz P.C.

(57) ABSTRACT

An ion cell having an axis includes a sheath of individual electrodes that extends along the axis and defines an internal volume. Adjacent individual electrodes are electrically insulated from each other. The individual electrodes each receive a DC potential and RF voltage. At least some of the individual electrodes have a width that varies in the axial direction such that an electrical effect on an axis potential varies along the axis of the ion cell.

20 Claims, 7 Drawing Sheets

ION MANIPULATION CELL WITH TAILORED POTENTIAL PROFILES

PRIORITY INFORMATION

This patent application claims priority from German Patent Application 10 2010 006 449.1 filed on Feb. 1, 2010 and German Patent Application 10 2010 013 546.1 filed on Mar. 31, 2010, each of which is hereby incorporated by reference.

FIELD OF THE INVENTION

This invention relates generally to ion manipulation cells and, more particularly, to manipulating guidance, focusing, bunching, storage, reactive change, and/or mass measurement via oscillations of ions using elongated RF ion cells with radial and axial potential profiles.

BACKGROUND OF THE INVENTION

Researchers have long been searching for RF multipole systems with axially superimposed electric potential profiles for the manipulation of ions in different ways, for example guiding the ions through sections of instruments ("ion guides"), even against flows of gas molecules. The ions may be manipulated, for example, for generation of longitudinal oscillations of the ions, for production of finely focused ion beams, for reactions between ions of opposite polarity, and/or for fragmentation and thermalization of ions. Ideally, axially superimposed electric potential profiles may be switched between different profile shapes. In addition to temporarily storing and thermalizing ions, such multipole systems should be able to, for example, fragment the ions via collisions with collision gas molecules and subsequently or simultaneously transport the fragmented ions to an exit at an end of the multipole system.

A "two-dimensional multipole field" may be defined as a field generated by alternatively applying two different voltages to two or more pairs of pole rods included in a multipole system. The voltages may be DC voltages or AC voltages. Effective radially repelling pseudoforces for ions, however, typically only occur with RF voltages.

Pole rods of a multipole system may be cylindrical sheath segments, rectangular plates, round rods or hyperbolic rods, depending on the desired quality of the multipole field. An ideal multipole field is generated in the vicinity of an axis, but typically only extends radially up to the pole rods when the pole rods have a certain hyperbolic shape. The multipole field may deviate for other shapes more or less strongly from the ideal multipole field, the greater the distance from the axis, which particularly affects the repulsive forces of the pseudopotential.

The radially repulsive pseudoforce produced by the pseudopotentials is typically strongest for RF quadrupole electrode systems having two pairs of pole rods. The ions in such quadrupole systems are trapped in a virtual tube, figuratively speaking, by repulsive pseudoforces which increase radially in each direction. The ions may move freely in the axial direction without an axial potential gradient; i.e., the ions are not trapped in the axial direction. The ions may oscillate freely about the axis with so-called "secular oscillations" under high vacuum conditions. The ion oscillations may be damped by collisions, however, in a medium vacuum, where the ions collect on the axis. The aforesaid process may be referred to as "collision focusing" or "thermalization" of the ions. Quadrupole systems with a linear potential drop along the axis correspond to sloping tubes where the content flows in one direction under the influence of the slope. They therefore form an "ion chute". Multipole systems with larger numbers of rod pairs, such as hexapole or octopole rod systems, have lower radially repulsive pseudoforces, but also form such tubes for ions. Axial potential profiles in such systems may also transmit or trap ions as a function of the shape of the profile.

A longitudinal electric field may be superimposed by producing a quadrupole electrode system out of four resistance wires, across each of which a DC voltage drop is generated in the same direction. The wires carry a relatively high RF voltage to generate the quadrupole RF field because the largest voltage drop occurs in the immediate vicinity of each wire. Resistance of each wire should not be particularly high because, otherwise, the RF alternating voltage cannot propagate quickly enough along the wires. Relatively small DC voltage drops therefore are typically generated along each wire. It may also be difficult to generate desired profiles of the DC electric field which are not simply linear voltage gradients along the axis. Ions may also be able to easily escape because the pseudopotential barrier between the wires is relatively low.

A longitudinal electric field may also be superimposed using a quadrupole system having a large number of parallel wires mounted so as to reproduce four hyperbolic surfaces of an ideal quadrupole system. Such a hyperbolic quadrupole system reproduced with wires was developed approximately 50 years ago by the research group of Wolfgang Paul. While quadrupole systems are difficult to produce and may be imprecise, they do provide a simple way of generating an axial DC field by generating voltage drops across the wires.

Other ion storage systems which have an electrically switched forward feed are disclosed in U.S. Pat. No. 5,572,035 to Franzen. The '035 patent discloses, for example, a system that includes two helically coiled conductors in a shape of a double helix, and operated by being connected to two phases of an RF voltage. The '035 patent also discloses a system including coaxial rings to which the phases of an RF AC voltage are alternately connected. Both systems may be operated to generate an axial feed of the ions. The double helix may be made from resistance wires across which a DC voltage drop is generated. The individual rings of the ring system may be supplied with a DC potential that changes from ring to ring. This may also be used to tailor desired shapes of axial potential profiles.

U.S. Pat. No. 5,847,386 to Thomson et al. discloses methods for generating an axial voltage drop in quadrupole round rod systems. In one embodiment, the quadrupole system is divided up into a large number of axially separated segments. The '386 patent also discloses penetrating resistance layers carrying a DC voltage drop with RF fields as DC potentials are introduced into the quadrupole rod system from the outside by surrounding electrodes.

U.S. Pat. No. 7,164,125 to Franzen et al. discloses generating axial DC potential profiles by insulated resistance layers.

Each of the aforesaid techniques, however, has various drawbacks. The disclosed systems, for example, may not provide ideal potential profiles, may be difficult to manufacture, and/or may not be switchable or adjustable.

In addition to the generation of axial DC voltage profiles in multipole systems, the generation of axial pseudopotential profiles is also of great interest. If one disregards very weak pseudopotential gradients in conical multipole rod systems, only pseudopotential barriers at the ends of multipole systems have been described up to now.

There is a need in the art therefore for elongated ion cells with electrically adjustable shapes of radial and axial distributions of DC potentials and pseudopotentials.

SUMMARY OF THE INVENTION

According to an aspect of the invention, an ion cell having an axis includes a sheath of individual electrodes that extends along the axis and defines an internal volume. Adjacent individual electrodes are electrically insulated from each other. The individual electrodes each receive a DC potential and RF voltage. At least some of the individual electrodes have a width that varies in the axial direction such that an electrical effect on an axis potential varies along the axis of the ion cell.

According to another aspect of the invention, a method is provided for using an ion cell having an axis, where the ion cell includes a sheath of individual electrodes that extends along the axis defining an internal volume, where adjacent individual electrodes are insulated from each other, and where at least some of the individual electrodes have a width that varies in the axial direction such that an electrical effect on an axis potential varies along the axis of the ion cell. The method includes providing a DC potential and a RF voltage to each of the individual electrodes.

According to another aspect of the invention, an ion cell includes an elongated interior volume surrounded by a pattern of individual electrodes. The individual electrodes are insulated from one another via, for example, insulating gaps. The insulating gaps do not predominantly run parallel to the axis. The individual electrodes may taper and/or widen as they extend in a longitudinal direction. The term "elongated interior volume" describes how the interior volume of the ion cell is longer in one direction than in the others. A longitudinal axis therefore extends between two ends of the ion cell along the longitudinal direction.

The individual electrodes may be supplied (e.g., in longitudinal groups) with different mixtures of DC and RF voltages. Both arbitrary radially storing pseudopotentials and arbitrary axial profiles of the DC potentials and pseudopotentials therefore may be generated. The potential profiles may be arbitrarily changed by changing the electric voltages supplied thereto. The individual electrodes of the ion cell may be shaped such that their respective electrical effect on the axis potential varies along the longitudinal axis. The individual electrodes may be supplied with electric potentials that generate not only radially repulsive potential profiles, but also different shapes of axial profiles of DC potentials and pseudopotentials, including potential wells or unidirectional potential gradients.

The interior volume may have any shape; e.g., an ellipsoid that is cut off at both ends, a truncated cone or a cylinder with a round, square or polygonal base.

A subgroup of individual electrodes may extend between two ends of the ion cell when the internal volume is a cylinder. The subgroup as a whole may have substantially the same width along substantially its entire length. Such a subgroup may be referred to as a "longitudinal group". A longitudinal group may be thought of as a rod electrode of a multipole rod system, which is divided into a plurality of insulated individual electrodes of varying width. The individual electrodes may be divided via slanted, straight and/or curved cuts. The envelope of the longitudinal group may have any form; e.g., a cylindrical surface segment, rectangular plate, round rod or a hyperbolic rod.

Each of the longitudinal groups of the ion cell may have substantially the same shape, and the individual electrodes may be arranged in substantially the same pattern. Individual electrodes that have the same shape at corresponding locations of the different longitudinal groups may be referred to as "corresponding individual electrodes".

An ion cell may include at least two pairs of longitudinal groups. Each longitudinal group may be constructed in a similar manner from individual electrodes and may be arranged symmetrically around the longitudinal axis. The individual electrodes of one longitudinal group may be supplied with an RF voltage having substantially the same frequency, amplitude and phase, where phase and opposite phase may alternate from longitudinal group to longitudinal group. Such an ion cell may be thought of as a multipole rod system whose pole rods have each been divided into individual electrodes by slanted (e.g., not parallel to the longitudinal axis), straight or curved cuts.

If an axial profile is produced from DC potentials in such a cell, the individual electrodes of a longitudinal group are each provided with different DC potentials. A potential profile in the interior of the cell which varies in the axial direction and is radially symmetric may be provided when corresponding individual electrodes are applied with the same DC potentials. Switchable DC potentials allow ions to, for example, be either stored in potential wells or ejected in the axial direction.

Axial profiles of the pseudopotentials may also be generated when individual electrodes of a longitudinal group are each supplied with RF voltages of substantially the same frequency and phase, but with different amplitudes. Both positive and negative ions may be stored in axial wells of such pseudopotentials. Similarly, the superposition of RF voltages with different frequency, amplitude or phase at a corresponding set of individual electrodes may produce an axial profile of the pseudopotentials.

Ion cells may be provided for collisionally induced fragmentation (CID) with the possibility of fast axial ejection of the product ions. Ion cells may be provided for reactions between positive and negative ions; e.g. for a fragmentation by electron transfer (ETD). Ion cells may be provided for the ejection of ions with temporal focusing of ions of the same mass (bunching effect). Ion cells may be provided for the ejection of ions with temporal and spatial focusing for each mass. Ion cells may be provided for ejection of the ions against a gas flow with measurement of their mobility. Ion cells may also be provided for a Fourier transform mass spectrometer with measurement of axial oscillations of the ions in a harmonic field.

These and other objects, features and advantages of the present invention will become more apparent in light of the following detailed description of preferred embodiments thereof, as illustrated in the accompanying figures.

DETAILED DESCRIPTION OF THE INVENTION

Figure 1:
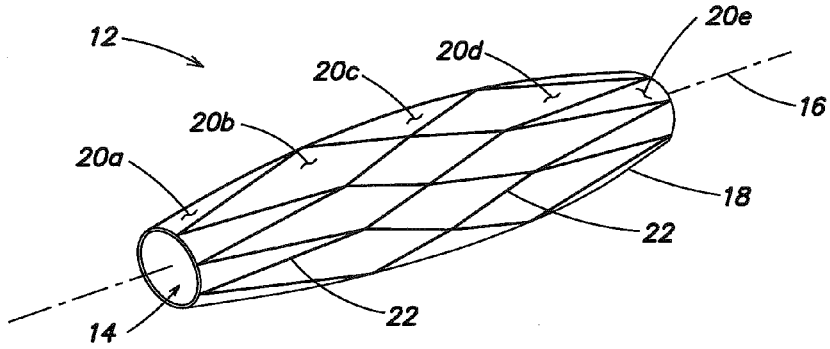
FIG. 1 illustrates a barrel-shaped quadrupole ion cell.

FIG. 1 illustrates a barrel-shaped ion cell 12 having an entrance aperture 14 connected to an elongated volume. The elongated volume extends in a longitudinal direction along a longitudinal axis 16, and is surrounded by a sheath 18 of individual electrodes 20*a*-20*e*. Each individual electrode tapers and/or widens as it extends in the longitudinal direction. Each individual electrode therefore has an electric potential that changes along the longitudinal axis 16, which has an effect on an axis potential. Adjacent individual electrodes are separated by insulating separating gaps 22. Each separating gap 22 may extend in a direction offset relative to the longitudinal axis 16. The separating gaps 22 may also extend in a zigzag pattern to accommodate individual electrodes with comb-like or sawtooth edges.

Each of the individual electrodes 20*a*-20*e* may be supplied with an independent mixture of DC and RF voltages such that diverse distributions of both the DC potential and the RF pseudopotential may be created within the ion cell 12. Potential profiles of almost any shape, defined for example by Laplace equations, may be generated along the longitudinal axis 16.

Figure 2A:
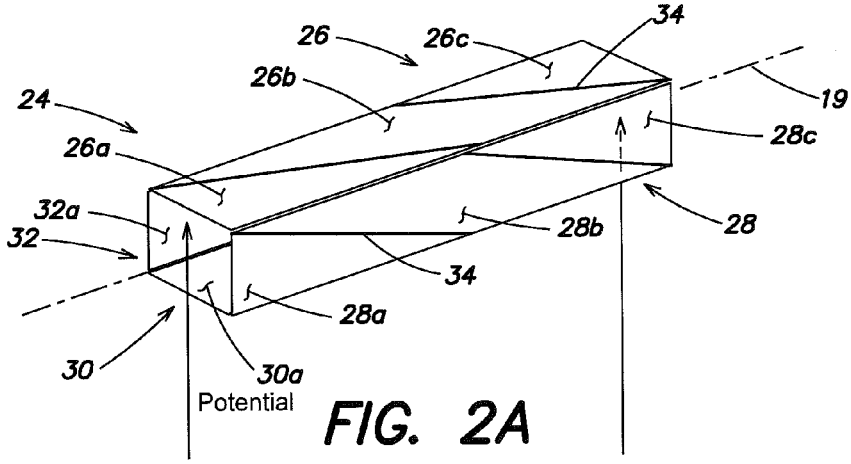
FIGS. 2A and 2B illustrate a quadrupole ion cell with four rectangular longitudinal groups, which may generate a potential profile P for storing ions of one polarity and a potential profile Q for ejecting ions.

FIG. 2A illustrates a quadrupole ion cell 24 that includes a plurality of longitudinal electrodes 26, 28, 30 and 32, which are sometimes referred to as "pole rods". Each longitudinal electrode (pole rod) includes a plurality of individual electrodes (e.g., 26*a-c*, 28*a-c*, etc.), which are separated by a plurality of slanted insulating separating gaps 34. Each individual electrode is insulated from adjacent electrodes by, for example, the separating gaps 34, and has a width that may vary in the longitudinal direction. The separating gaps 34 insulate adjacent individual electrodes from one another. The separating gaps 34 may be open, or filled at least partially with an insulating material.

The individual electrodes in each longitudinal electrode may form a "longitudinal group". Each longitudinal group of individual electrodes extends between two ends of the ion cell 24, and may have a substantially constant width. The ion cell 24 in FIG. 2A, for example, includes four plate-type longitudinal groups. The individual electrodes in the longitudinal groups may be, for example, jointly supplied with RF voltages. Corresponding individual electrodes in different longitudinal groups may be, for example, supplied with substantially the same DC potentials. An RF multipole system therefore is provided with an axial DC voltage profile.

Figure 3A:
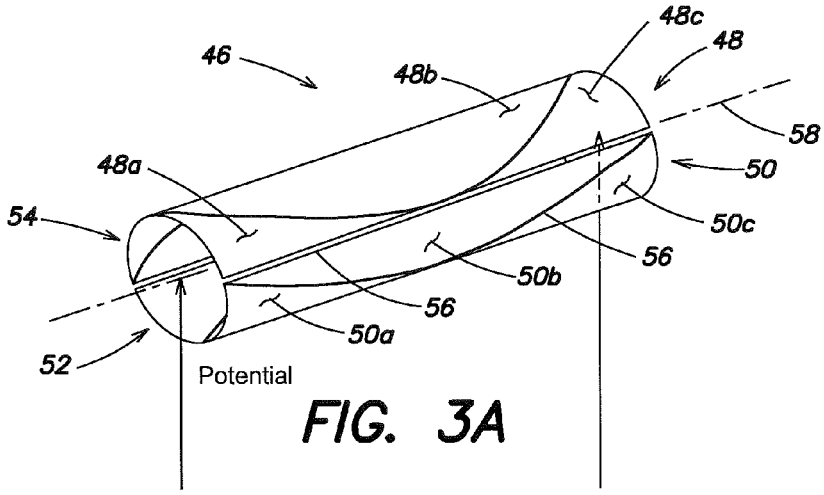
FIGS. 3A and 3B illustrate a quadrupole ion cell with four cylindrical longitudinal groups, which may generate a precisely parabolic potential well R in a longitudinal axis of the cell.
Figure 4:
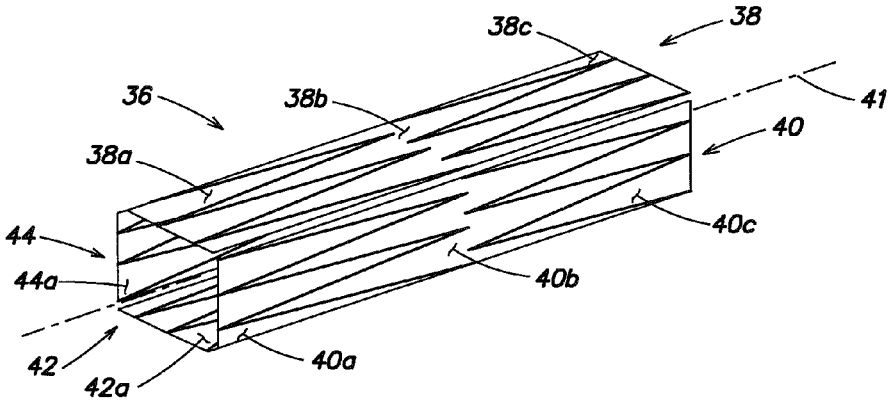
FIG. 4 illustrates an alternative embodiment of the ion cell illustrated in FIG. 2A.
Figure 5:
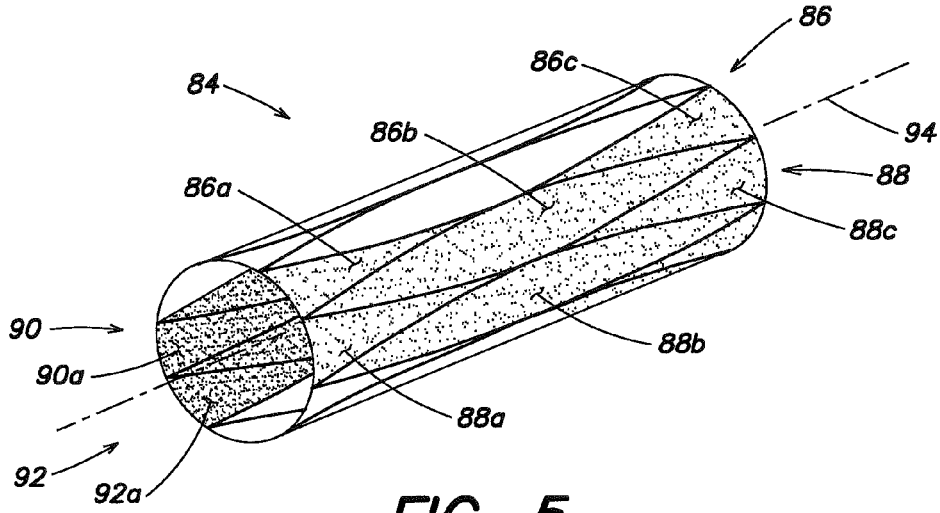
FIG. 5 illustrates an alternative embodiment of the ion cell illustrated in FIG. 3A.
Figure 8:
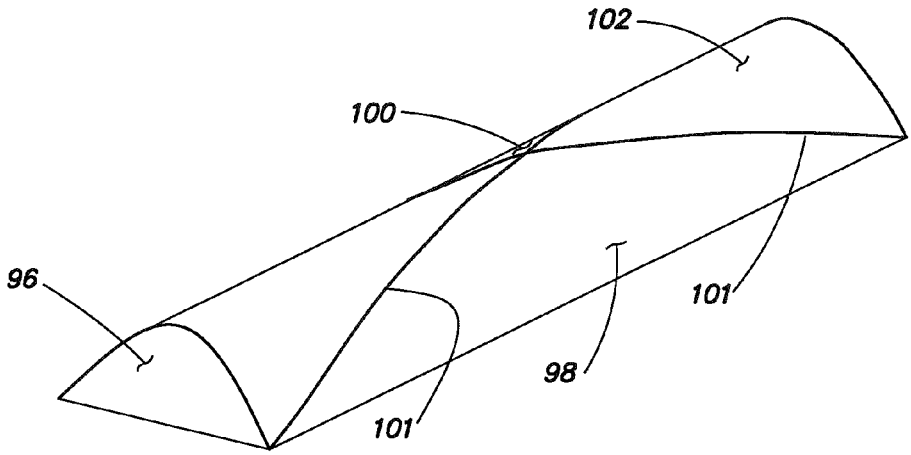
FIG. 8 illustrates a hyperbolic longitudinal group that includes a plurality of individual electrodes.

Referring to FIGS. 2A, 3A, 4, 5 and 8, the longitudinal groups may be configured into a plurality of different geometries: e.g., cylindrical sheath segments as shown in FIGS. 3A and 5, rectangular plates as shown in FIGS. 2A and 4, round rods and hyperbolic rods as shown in FIG. 8. The longitudinal groups may be straight as shown in FIG. 2A, or twisted in the longitudinal direction as shown in FIG. 5. The longitudinal groups may be constructed, for example, by dividing rectangular plates (see FIGS. 2A and 4) or cylindrical sheath segments (see FIGS. 3A and 5) to form the individual electrodes. Dividing round or hyperbolic rods (see FIG. 8) is slightly more difficult but, given a suitable electrical configuration, it provides RF multipole fields that are roughly ideal, even very far from the axis. Round and hyperbolic rods may also provide uniform, harmonically repulsive pseudoforces.

The individual electrodes may be discretely manufactured and subsequently assembled to form in an electrode sheath and/or longitudinal groups.

The individual electrodes in each longitudinal group may be arranged in a uniform pattern as shown in FIGS. 2A, 3A, 4 and 5. In some embodiments, the individual electrodes in each longitudinal group may be supplied with substantially the same RF voltage; e.g., each individual electrode may receive a RF voltage having substantially the same frequency, amplitude and phase. Corresponding individual electrodes in different longitudinal groups may be supplied with substantially the same DC potentials, as is shown in FIG. 7.

Figure 2B:
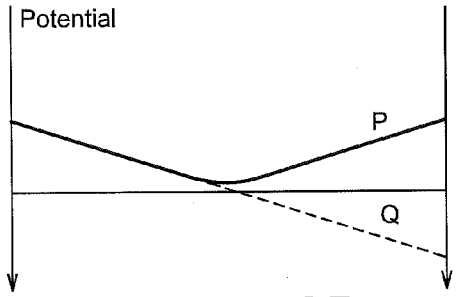
Figure 7:
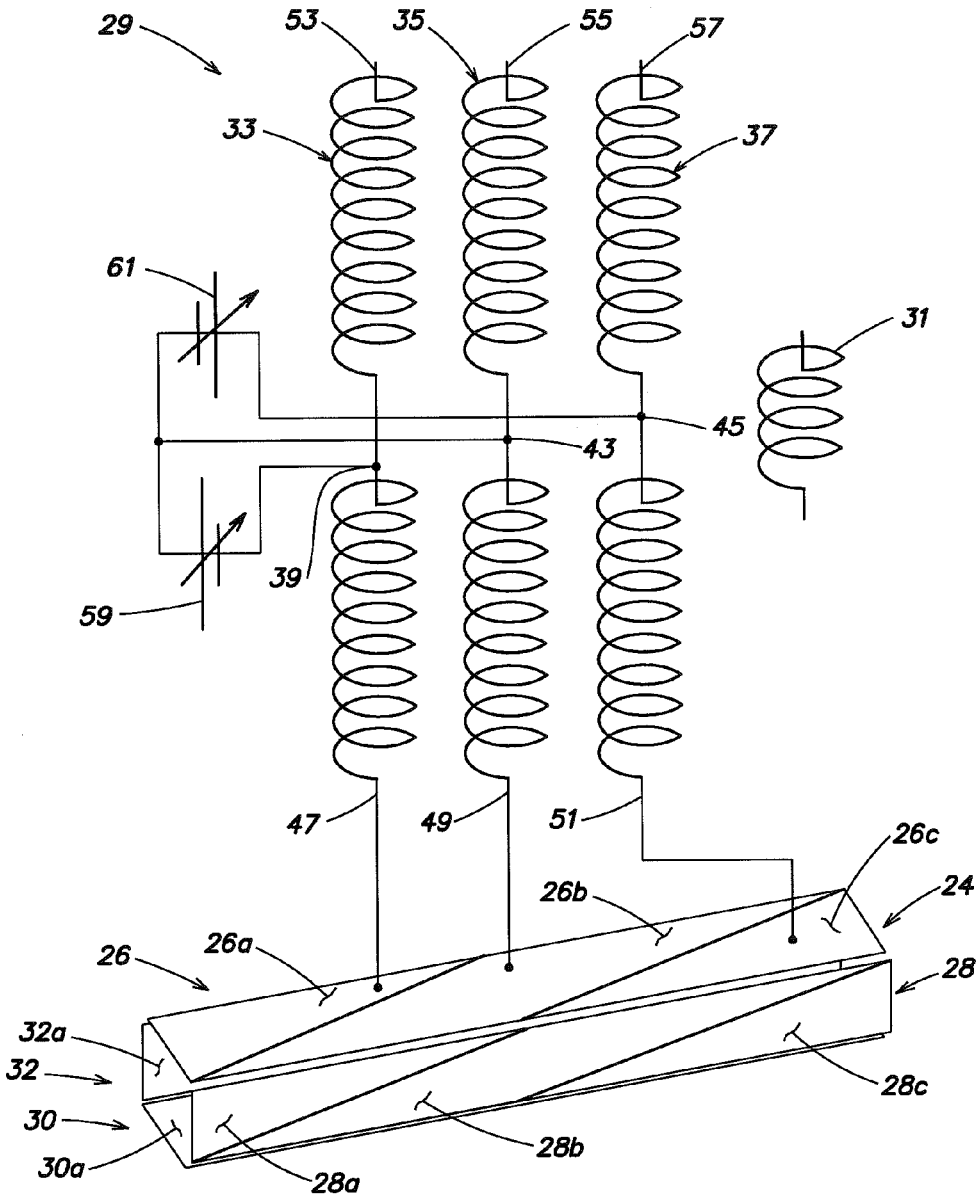
FIG. 7 illustrates a power supply for the ion cell illustrated in FIG. 2.

FIG. 7 illustrates a power supply 29 for the ion cell 24 illustrated in FIG. 2. The power supply 29 includes a primary coil 31 coupled to three secondary coils 33, 35 and 37, which are each equipped with center taps 39, 43 and 45, and whose RF outputs are each connected to the individual electrodes of a longitudinal group (and its opposite group). Outputs 47, 49 and 51 of the secondary coils 33, 35 and 37 are connected to the individual electrodes (e.g., 26*a*, 26*b* and 26*c*), and to the respective opposing individual electrodes (e.g., 30*a*, etc.). Outputs 53, 55 and 57 are connected to the individual electrodes (e.g., 28*a* and 32*a*, etc.), which connections are not shown in the intent of ease of illustration. Adjustable or switchable potential differences 59 and 61 between the individual electrodes may be generated via the center taps 39, 43 and 45. The switchable DC potentials 59 and 61 make it possible to either store ions in a potential well (see P in FIG. 2*b*) or eject ions by a directed potential drop (see Q in FIG. 2*b*) in the axial direction. When each of the DC potentials are substantially equal, the embodiment corresponds to a "pure" quadrupole rod system without axial field gradients.

Axial profiles of pseudopotentials are generated in the interior of the ion cell when the individual electrodes of a longitudinal group are not supplied with the same RF voltages. The individual electrodes, for example, may be supplied with RF voltages having different amplitudes and/or frequencies.

Referring again to FIG. 2A, the quadrupole ion cell 24 may create a potential profile along its longitudinal axis 19. Influences of the potentials of the individual electrodes (e.g., 26*a-c*, 28*a-c*, etc.) which are not cancelled out by symmetry, however, may become noticeable. The attraction between ions and some electrodes, for example, may become larger than the retroactive pseudoforces. The potential profile which prevails on the axis therefore does not necessarily prevail uniformly in the axial direction on an (imaginary) circular trajectory around the axis. Rather, the axial and radial electric fields are modulated along an orbit with four maxima and minima The maxima and minima, for example, may become more pronounced the further the circular trajectory is from the axis. A correspondingly large repulsion by a pseudopotential therefore may overcome the radial attraction of the ions by the voltage on the individual electrodes. The axial and radial modulation, however, may disturb some applications.

FIG. 4 illustrates a quadrupole ion cell 36 that includes a plurality of longitudinal groups, which are divided into a plurality of individual electrodes 38*a-c*, 40*a-c*, etc. Both the axial and the radial modulations of the DC field on a virtual circular trajectory around the longitudinal axis 41 of the ion cell 36 have a relatively high frequency and relatively small differences between the maxima and the minima. The ion cell 36 may be used to generate the same type of potential profile in the longitudinal axis as the ion cell 24 in FIG. 2A. The potential profile produced by the ion cell 36, however, also prevails approximately at some distance from the axis.

Referring to FIG. 4, the ion cell 36 may be used as an ion mobility spectrometer (IMS), or as a collision cell for collisional fragmentation (CID). When using the ion cell 36 as an ion mobility spectrometer, a substantially constant gas stream through the cell is created to blow ions out of the cell. If the ions are initially collected in the potential well, and the depth of the potential well is continuously decreased, the ions may leave the cell when the gas stream blows the ions over a remaining field threshold on the upward slope of the well. The ions may leave the ion cell 36 therefore when the mobility-dependent friction with the molecules of the gas stream overcomes the force of the opposing electric field. Measuring the ions blown out of the ion cell 36 as a function of the well depth produces the mobility spectrum.

The multipole ion cell 36 with the individual electrodes in zigzag form may be manufactured using electronic circuit boards, metalized glass, ceramic or glass-ceramic plates. The rectangular pole plates of the quadrupole rod system are each divided by zigzag cuts into longitudinal groups, each having three individual electrodes. At the two ends and in the middle, an individual electrode extends substantially the entire width of the longitudinal group. By supplying the individual electrode with RF and DC voltages, similar to the supply shown in FIG. 7, it is possible to set a DC potential well similar to P in FIG. 2*b* or to set an ejection profile similar to Q in FIG. 2*b*.

Referring still to FIG. 4, the quadrupole ion cell 36 having zig-zagged electrodes 38*a*-44*c* and its power supply is particularly suitable for fragmenting ions by collisions with a collision gas. The ions may be fragmented, for example, by filling the cell with a collision gas (e.g., helium or nitrogen) at a pressure of between approximately 0.3 and 10 Pascals, which provides a mean free path of between approximately thirty and one millimeter. The potential well may be set, for example, to a depth of approximately 30 to 50 volts. Low-energy ions, axially introduced into the cell 36 are trapped in the potential well by collisional deceleration, and oscillate in the potential well until their oscillatory energy is depleted. The low-energy ions absorb small amounts of energy through non-elastic collisions, and may decompose into fragment ions through ergodic processes after, for example, less than approximately one millisecond. Each of the ions collects, collision-focused, in the center of the potential well in the middle of the cell 36. The ions may be ejected and guided to a mass analyzer for the acquisition of a fragment ion mass spectrum by switching over the axial potential profile from P to Q.

The ion cell 36 may be manufactured by fixing the individual electrodes to a surrounding, insulating mounting frame (not shown), for example, made of glass, ceramic or plastic. It may be simpler to use electronic circuit boards, however, on which the individual electrodes of a longitudinal group are produced via etching metal layers. Increasing the number of zig-zag paths may improve the performance of the cell. The ion cell may alternatively be manufactured using glass, ceramic or glass-ceramic plates metalized on one side. The metal layers are divided into the individual electrodes of a longitudinal group by milling or sawing. Where a diamond-coated wire is used for sawing the metalized plates, for example, the cut may be relief milled so deeply that it is of hardly any consequence if impacting ions charge up the insulating body.

Figure 3B:
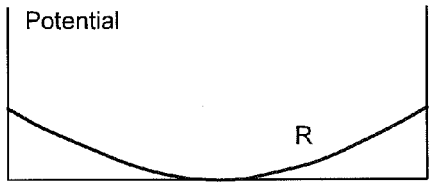

FIGS. 3A and 3B illustrate a cylindrical quadrupole ion cell 46 having an axial potential profile that may assume a desired form. The ion cell 46 includes four pole rods, each configured as cylindrical sheath segment 48, 50, 52, 54. The cylindrical sheath segments 48, 50, 52 and 54 may be produced by cutting open the cylinder surface in the longitudinal direction. The cylindrical sheath segments 48, 50, 52 and 54 are divided into individual electrodes (e.g., 48*a*-*c*, 50*a*-*c*, 52*a*, 54*a*-*b*, etc.) by a separating gap 56. The individual electrodes formed from each cylindrical sheath segments form longitudinal groups, which correspond to the original pole rods. The ion cell may produce, for example, a parabolic potential well R on the axis potential when the separating gaps have a parabolic shape, as shown in FIG. 3B. The parabolic shape of the separating gaps refers here to the unrolled, flat cylindrical sheath surface.

Referring to FIG. 3A, the ion cell 46 may be used to measure the harmonic axial oscillations of ions. The ion cell 46 may be operated under ultra-high vacuum (e.g., below $10^{-7}$ Pascal) and hyperbolic end caps, which serve to close off the parabolic DC field and to measure the induced image currents, are mounted at both ends. The ion cell 46 is initially operated with a shallow potential well and carefully filled with ions precisely in its axis 58. Ideally, the ions should have no radial components of motion. Such filling is known from ion cyclotron resonance mass spectrometers (ICR-MS). After filling, the potential well is made deeper by changing the voltages on the individual electrodes to a few kilovolts. The change of voltage may cause the ions to collect in the center of the potential well. Coherent excitation of the axial oscillations with a chirp pulse on the outer individual electrodes or on the end cap electrodes may be used to excite the ions to perform oscillations whose amplitude is independent of their mass, but whose frequency is mass-dependent. The hyperbolic end cap electrodes may be used to measure an image current transient via the image currents. A Fourier analysis may determine the oscillation frequencies of the individual ionic species, and therefore the masses from the image current transient.

Figure 6:
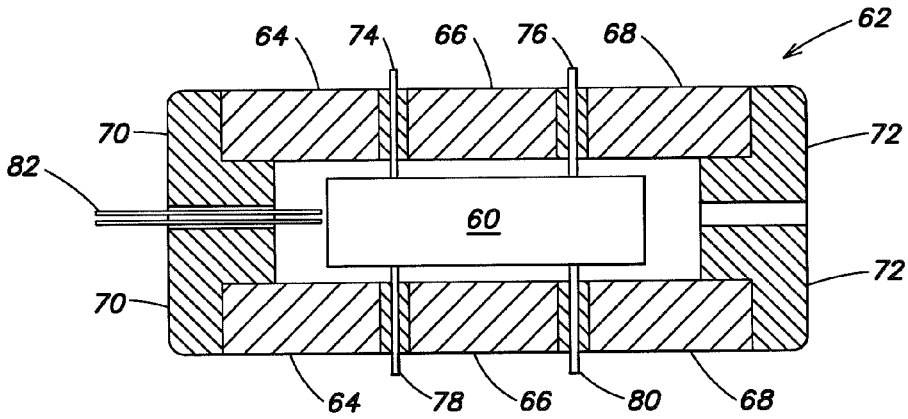
FIG. 6 illustrates a quadrupole ion cell embedded into a magnetic field of a permanent magnet.

FIG. 6 illustrates a quadrupole ion cell 60 embedded in a magnetic field of a magnet 62. The ion cell 60 may be a quadrupole ion cell having a parabolic axis potential as shown in FIGS. 3A and 5. The magnet 62 includes a plurality of annular permanent magnets 64, 66 and 68 disposed between yokes 70 and 72. Alternatively, the permanent magnets may be replaced with one or more electric coils. A plurality of annular soft iron components with feed-throughs 74, 76, 78 and 80 are positioned between the magnets 64, 66 and 68. A hexapole RF ion guide 82 is configured with the yoke 70 to guide ions to the ion cell 60.

The magnet 62 maintains ions in the ion cell 60 on the longitudinal axis. The magnetic field, for example, runs parallel to the longitudinal axis of the cell 60 such that ions experience at least a time-averaged parabolic potential (see FIG. 3B) in the axial direction even when they are located slightly away from the longitudinal axis. In the magnetic field, the space charge causes ion clouds to rotate around themselves. The rotation causes the modulation of the axial field on the circular trajectories of the ions to be averaged out. Each of the ions then oscillates harmonically in substantially the same parabolic potential well. Oscillation spectrometers with application of Fourier transformation of image currents are among the mass spectrometers with the highest mass resolution and highest mass accuracy.

Referring again to FIG. 3A, the individual electrodes may be fixed, as is common for ICR measuring cells, in rings of ceramic or glass ceramic (e.g., Macor). It is also possible to produce the individual electrodes from a tube of ceramic or glass ceramic which is metalized in the inside, for example, by etching or machining. It is also possible to cut the tube into four longitudinal pieces of the cylindrical sheath, to mill the separating gaps, and to put the longitudinal pieces back together again. Each longitudinal piece may then support a longitudinal group.

The modulation of the DC field away from the axis may be reduced by including a larger number of individual electrodes. For example, FIG. 5 illustrates a cylindrical ion cell 84 that includes eight individual electrodes (e.g., 86*a-c*, 88*a-c*, etc.) around its circumference. The ion cell 84 may still generate a quadrupole field by grouping together, for example, six adjacent individual electrodes (e.g., electrodes 86*a-c* and 88*a-c*) to form a longitudinal group with substantially the same RF voltage. The individual electrodes, however, may have different DC potentials that may generate, for example, a precisely parabolic longitudinal profile of the axis potential.

Each longitudinal group in the ion cell 84 extends along a centerline (not shown) such that none of the separating gaps are parallel to the axis 94. The individual electrodes (e.g., 86*a-c* and 88*a-c*) may, however, be grouped together to form equally wide, slightly twisted, longitudinal groups 86 and 88 which, like the electrodes in their counter-groups 90 and 92, are supplied with substantially the same RF voltage. The slight twisting of the RF quadrupole field in the interior has hardly any negative effect. The slight twisting, however, may balance out the modulation. Embedding the ion cell 84 into an axial magnetic field may improve the coherence of the oscillations for ions having substantially the same mass.

In some embodiments, half the ion cell shown in FIG. 3A or 5 (from one end to the center) may be used to set a potential which increases parabolically on one side. If such an arrangement is operated in a vacuum that allows thermalization of the ions, but does not substantially hinder ejection of the ions by collisions with the residual gas, collected and thermalized ions may be ejected by switching on the parabolic ejection potential. The collected and thermalized ions may be ejected such that each ion is subject to spatial focusing to a distant point. The ejected ions, however, may reach the focal point temporally separated according to mass. The aforesaid effect is called "bunching", and may be used, for example, to operate a time-of-flight mass spectrometer.

Some applications may use a one-sided forward drive of the ions. Such a one-sided forward drive may be achieved with the ion cell 24 in FIG. 2A. A one-sided forward drive may also be achieved with a ion cell where each longitudinal group includes two, rather than three, individual electrodes. The ion cell may be formed using, for example, half of the ion cell 24 in FIG. 2A. The power supply in FIG. 7 therefore would include two, rather than three, secondary windings. Such an embodiment may be used as a beam-shaping device. In this case the ions are driven into its axis by focusing in a collision gas, and guided through the ion cell by a slight electric forward drive. If the forward drive is so slow that practically complete collision focusing is achieved, a very fine ion beam may be provided, as is used, for example, in time-of-flight mass spectrometers with orthogonal ion injection. A device according to FIG. 4 in half length may also advantageously be used for this purpose.

When the collision-focusing RF field is as ideal as possible away from the axis, hyperbolic pole rods may be used that are cut into longitudinal groups with individual electrodes by straight or curved cuts. FIG. 8 illustrates such a pole rod, which is divided into four individual electrodes 96, 98, 100 and 102. Cuts 101 that divide the pole rod run horizontally (with reference to the flat, rectangular base) or vertically through its cross-section. The cuts 101 may be made, for example, cross-wise vertically through the hyperbolic pole rod. This embodiment with hyperbolic pole rods may also be used in half length for a device that uses a one-sided forward drive of the ions.

The individual electrodes of a longitudinal group in the ion cell 24 in FIG. 7 receives, as set forth above, RF voltages having substantially the same amplitude, frequency and phase. The individual electrodes, however, may also be supplied with RF voltages having different amplitudes, frequencies and/or phases to produce pseudopotential profiles in the interior of the cell along the axis of the multipoles. The pseudopotential profiles may be provided alone, or in conjunction with additional axial profiles of a DC potential. Superpositions of different RF voltages, for example, with different frequencies may also be used.

Figure 9:
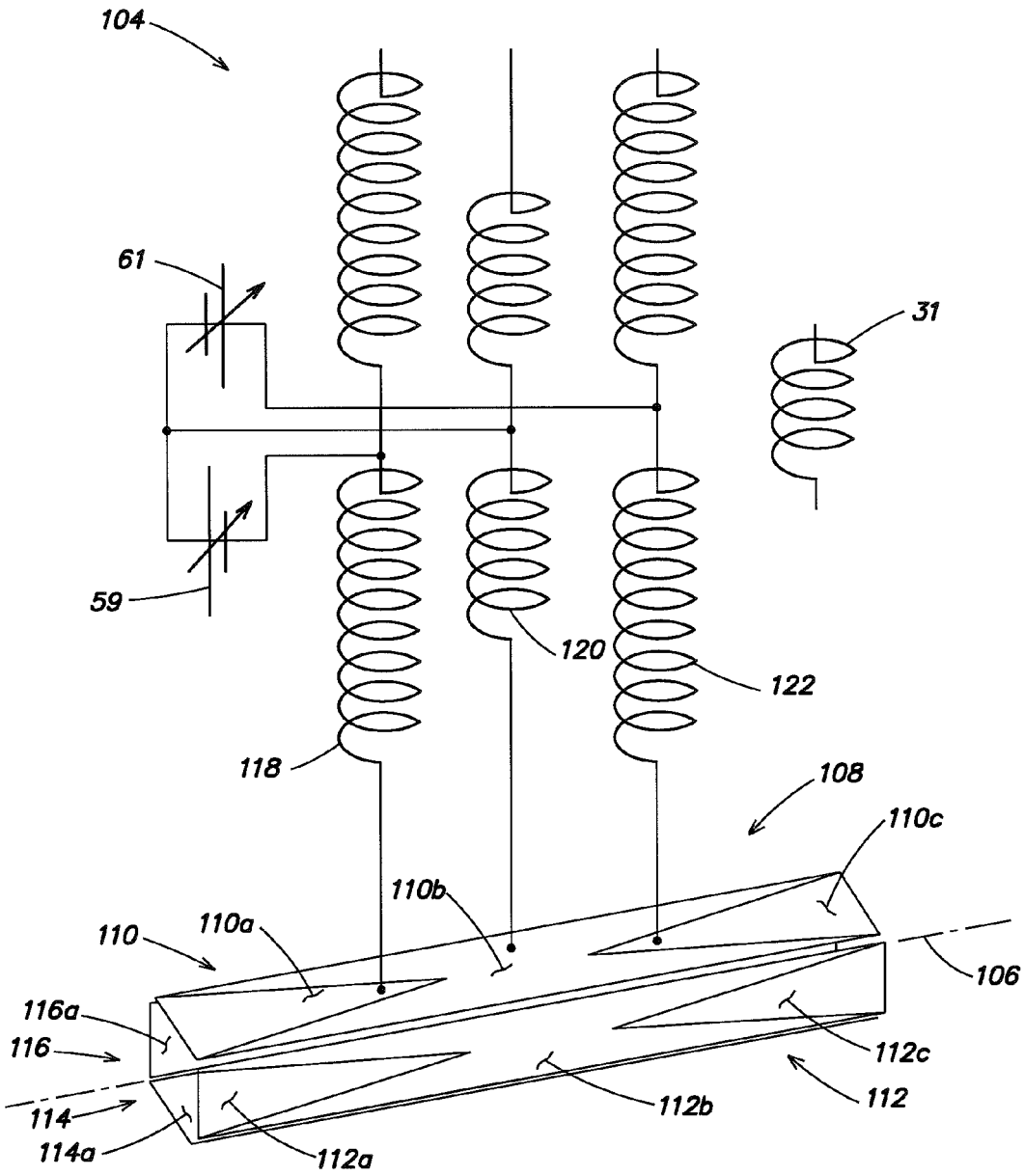
FIG. 9 illustrates an alternative power supply for a quadrupole ion cell.

FIG. 9 illustrates a power supply 104 that may superimpose switchable DC voltage profiles on a fixed well of a pseudopotential along a longitudinal axis 106 of an ion cell 108 with a quadrupole arrangement of longitudinal groups 110, 112, 114 and 116. The well of the pseudopotential is generated by designing the secondary windings 118, 120, 122 of the high voltage transformer such that the RF voltage applied to the outer individual electrodes (e.g., 110*a*, 110*c*, 112*a*, 112*c*, etc.) has a greater amplitude than the RF voltage applied to the central individual electrodes (e.g., 110*b*, 112*b*, etc.). In the embodiment shown in FIG. 9, for example, number of turns/lengths of the secondary windings 118 and 122 are each greater than the turns/length of the secondary winding 122. The outer individual electrodes 110*a* and 110*c* (and the corresponding individual electrodes of the other longitudinal groups) do not extend as far into the center as in the ion cells shown in FIGS. 2A and 4. This form of the individual electrodes produces a slightly wider, but deeper, pseudopotential well. The ion cells in FIGS. 2A and 4, however, may also be used with the power supply 104.

Positive and negative ions may be stored in the ion cell 108 at the same time to, for example, fragment multiply positively charged analyte ions by electron transfer dissociation (ETD). The fragment ions that collect in the center of the cell may be ejected from the cell by applying a DC voltage gradient, and guided to a mass analyzer.

A time-of-flight mass spectrometer with orthogonal ion injection may be used for the mass analysis. Orthogonal ion injection requires a narrow ion beam into a pulser, which pulses out segments from the ion beam perpendicular to the previous direction of flight of the ions and into the flight tube. The time of flight of these ions is measured. Ions of all masses of interest may be included in the narrow beam at the time the pulsing out occurs. If the operation for the fragmentation is intermittent, however, a simple ejection of the ions from the fragmentation cell may provide mass discrimination because of the different flight times to the pulser; i.e., the pulser does not contain ions of different masses simultaneously.

Mass discrimination may be compensated for with the system in FIG. 9 using a suitable mode of operation. The fragment ions and other types of ion mixtures may be ejected using a controlled increase of the DC voltage gradient such that the relatively heavy ions, for which the pseudopotential well is less deep, are ejected before the relatively light ions. Ions of different mass may reunite in the pulser despite their different flight times. A temporal ion focusing for ions of the different masses therefore may be produced.

A temporal ion focusing for ions of different masses may also be provided by applying counteracting axial pseudopotentials and DC potentials. Heavy ions are driven further into the pseudopotential than light ones because the pseudopotential has a mass-dependent effect, whereas the DC potential does not. The mass-dependent spatial distribution of the ions may then be used during an ejection such that heavy ions and light ions arrive at substantially the same time in the pulser of the time-of-flight mass spectrometer.

In the system shown in FIG. 9, the pseudopotential well is fixed by the design of the secondary windings 118, 120 and 122 of the transformer. Alternatively, a system may use two transformers that generate high voltages of substantially the same frequency and phase. A transformer with two secondary windings supplies the outer individual electrodes, and a transformer with one secondary winding supplies the central individual electrodes. The transformer with one secondary winding may also be controlled such that the well of the pseudopotential may be selected with controllable depth. It is also possible to generate a multipole field without a pseudopotential well.

Figure 10:
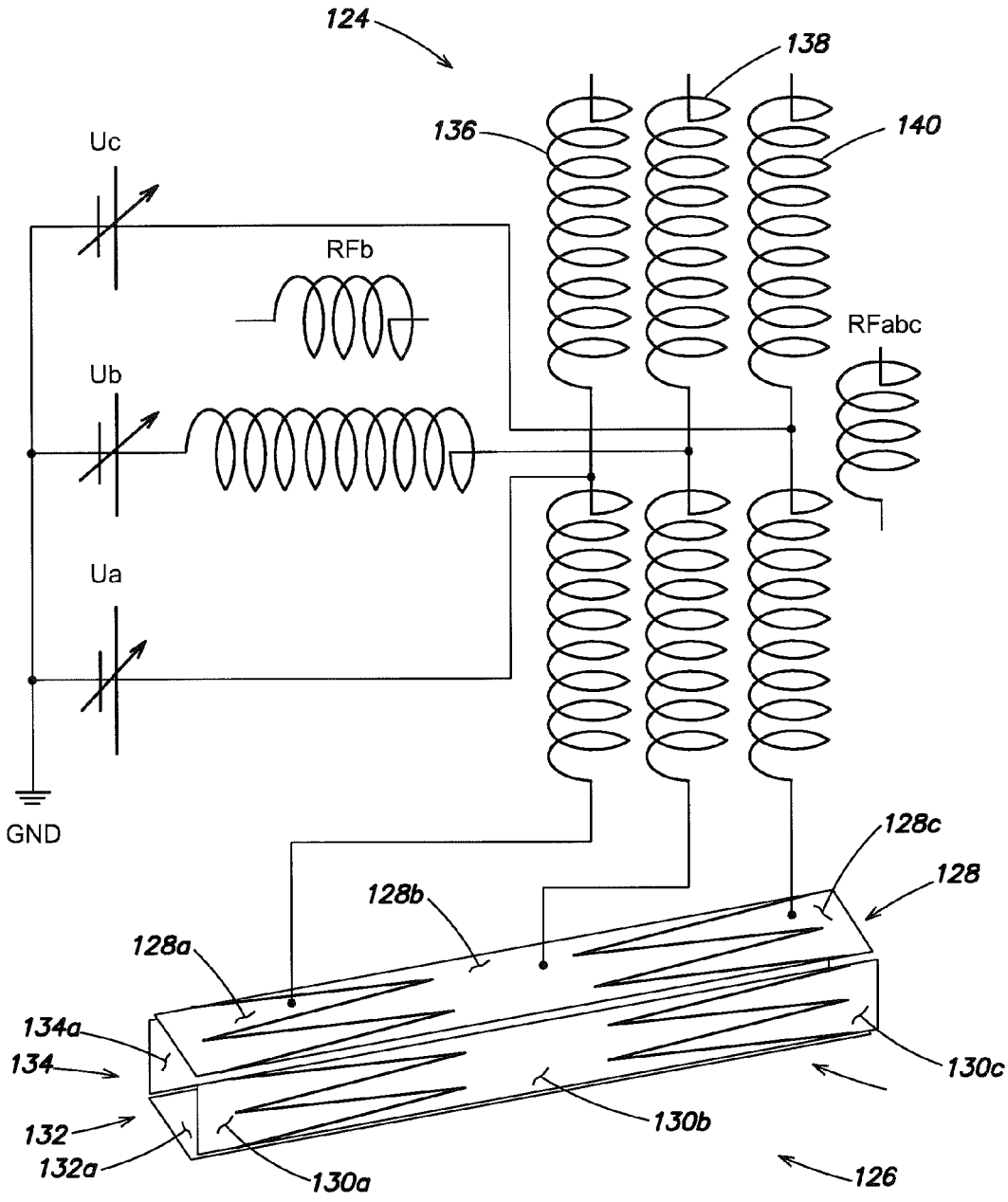
FIG. 10 illustrates another alternative power supply for a quadrupole ion cell.

FIG. 10 illustrates a power supply 124 that may generate a pseudopotential of adjustable depth in a quadrupole ion cell 126. Three DC potentials $U_a$, $U_b$ and $U_c$ and two RF voltages $RF_{abc}$ and $RF_b$ may be applied to individual electrodes (e.g., 128*a-c*, 130*a-c*, 132*a*, 134*a*, etc.) in longitudinal groups 128, 130, 132 and 134, respectively. The single-phase RF voltage $RF_b$, whose amplitude can be controlled, may generate an axial pseudopotential well where ions of both polarities may be stored. The frequency of the RF voltage $RF_b$ may be selected to have any frequency value. The frequency value of the RF voltage $RF_b$ may, for example, be equal to the frequency of the RF voltage $RF_{abc}$. The frequency value of the RF voltage $RF_b$ may, alternatively, be less than, for example, approximately one half or one quarter of the frequency of $RF_{abc}$.

The ion cell 126 with this type of electrical configuration represents a type of ion cell for universal use. It may be used, for example, with a DC voltage well for collision-induced fragmentation rather that a pseudopotential well. Positive and negative ions may be stored at the same time, however, with the pseudopotential well for a fragmentation of multiple positively charged ions by electron transfer (ETD) from suitable negative reaction ions. When the ion cell 126 is operated with an adjustable pseudopotential well, stray fields at the ends of the ion cell are not changed. Neither the injection conditions nor the effects on adjacent systems therefore change. Both a DC voltage well and an ion chute may be generated by the DC potentials $U_a$, $U_b$ and $U_c$. An adjustable interaction of ion slide and pseudopotential well allows the ions to be ejected mass-sequentially, where heavy ions are ejected first. The ion cell may therefore generate a very fine ion beam, as is used for time-of-flight mass spectrometers with orthogonal ion injection.

FIG. 10 illustrates a transformer with three secondary windings 136, 138 and 140 for the generation of the two-phase RF voltage $RF_{abc}$. If the secondary windings have an interfering effect on each other, two or three individual transformers may also be used. When two transformers are used, two secondary windings may be available to supply, for example, the outer individual electrodes with voltages having the same amplitude. When two or three transformers are used, additional degrees of freedom for the RF voltages may be supplied to the ion cell, which makes it possible to generate different types of potential profile.

The descriptions provided above have focused on multipole-type ion cells with symmetrically arranged longitudinal groups and straight longitudinal axis. With knowledge of this invention, those skilled in the art will be able to develop many further advantageous embodiments of ion cells and their electrical configurations for many different types of applications, for example banana-shaped or semi-circular ion cells with potential gradients, ion cells for the radial ejection of the ions, ion cells with several DC potential or pseudopotential wells to store different types of ions at different locations, and many more. Various changes, omissions and additions to the form and detail the disclosed invention therefore may be made therein without departing from the spirit and scope of the invention.

What is claimed is:

1. An ion cell having an axis, comprising a sheath of individual electrodes that extends along the axis and defines an internal volume having a shape of an ellipsoid that is cut off at both ends, where adjacent individual electrodes are electrically insulated from each other, where the individual electrodes each receive a DC potential and RF voltage, and where at least some of the individual electrodes have a width that varies in the axial direction such that an electrical effect on an axis potential varies along the axis of the ion cell.

2. An ion cell having an axis, comprising a sheath of individual electrodes that extends along the axis and defines an internal volume, where adjacent individual electrodes are electrically insulated from each other, where the individual electrodes each receive a DC potential and RF voltage, and where at least some of the individual electrodes have a width that varies in the axial direction such that an electrical effect on an axis potential varies along the axis of the ion cell, where the individual electrodes form longitudinal groups, and where each longitudinal group extends between two ends of the ion cell and has an equal width over a length of the ion cell.

3. The ion cell of claim 2, where each longitudinal group forms at least one of a cylindrical sheath segment, a rectangular plate, a round rod and a hyperbolic rod.

4. The ion cell of claim 2, where the RF voltages received by the individual electrodes of a longitudinal group have substantially equal frequencies, amplitudes and phases, and where the phase alternates between different longitudinal groups.

5. The ion cell of claim 2, where the longitudinal groups are each constructed in a uniform pattern from the individual electrodes, and corresponding individual electrodes in different longitudinal groups are each supplied with a substantially equal DC potential.

6. The ion cell of claim 2, where the individual electrodes of a longitudinal group are supplied with RF voltages having at least one of different amplitudes, different frequencies, and different phases.

7. The ion cell of claim 2, where the individual electrodes of a longitudinal group are each supplied with mixtures of different RF voltages.

8. The ion cell of claim 2, where at least one of the DC potentials and the RF amplitudes are changed using a controller.

9. The ion cell of claim 3, where the longitudinal groups of electrodes comprise cylindrical sheath segments divided by parabolic separating gaps.

10. The ion cell of claim 9, further comprising a magnet, where the ion cell is embedded in a magnetic field of the magnet.

11. The ion cell of claim 2, where the individual electrodes comprise a plurality of metal layers applied to one of plastic, ceramic, glass ceramic and glass.

12. The ion cell of claim 2, where the individual electrodes comprise a plurality of metal pieces fixed to a holding frame made of one of plastic, ceramic, glass ceramic and glass.

13. A method for using an ion cell having an axis, where the ion cell includes a sheath of individual electrodes that extends along the axis defining an internal volume, where adjacent individual electrodes are insulated from each other, and where at least some of the individual electrodes have a width that varies in the axial direction such that an electrical effect on an axis potential varies along the axis of the ion cell, where the individual electrodes form longitudinal groups, and where each longitudinal group extends between two ends of the ion cell and has an equal width over a length of the ion cell, the method comprises providing a DC potential and a RF voltage to each of the electrodes.

14. The method of claim 13, further comprising providing a collision gas for fragmenting ions within the ion cell.

15. A method for using an ion cell having an axis, where the ion cell includes a sheath of individual electrodes that extends along the axis defining an internal volume, where adjacent individual electrodes are insulated from each other, and where at least some of the individual electrodes have a width that varies in the axial direction such that an electrical effect on an axis potential varies along the axis of the ion cell, the method comprises providing a DC potential and a RF voltage to each of the electrodes, further comprising using the ion cell in a mass spectrometer, and measuring harmonic oscillations of ions within the mass spectrometer, where the individual electrodes form longitudinal groups, where each longitudinal group extends between two ends of the ion cell and has an equal width over a length of the ion cell, and where each longitudinal group forms cylindrical sheath segments that are divided by parabolic separating gaps.

16. The method of claim 13, further comprising using the ion cell for reactions between positive and negative ions.

17. The method of claim 13, further comprising using the ion cell to generate a narrow ion beam in a time-of-flight mass spectrometer with orthogonal ion injection.

18. The method of claim 13, further comprising using the ion cell to measure ion mobilities.

19. The ion cell of claim 2, wherein the individual electrodes are divided via at least one of slanted, straight, and curved cuts.

20. The ion cell of claim 2, wherein the individual electrodes are divided by separating gaps which extend in a zigzag pattern to accommodate individual electrodes with comb-like or saw-tooth edges.

* * * * *